US010052516B1

(12) United States Patent
Lin

(10) Patent No.: US 10,052,516 B1
(45) Date of Patent: Aug. 21, 2018

(54) FOLDABLE EXERCISE BIKE

(71) Applicant: BH ASIA LTD., Taichung (TW)

(72) Inventor: Fu Hai Lin, Taichung (TW)

(73) Assignee: BH Asia Ltd., Taichung (TW)

( * ) Notice: Subject to any disclaimer, the term of this patent is extended or adjusted under 35 U.S.C. 154(b) by 0 days.

(21) Appl. No.: 15/601,164

(22) Filed: May 22, 2017

(51) Int. Cl.

| | |
|---|---|
| ***A63B 22/00*** | (2006.01) |
| ***A63B 21/00*** | (2006.01) |
| ***A63B 21/008*** | (2006.01) |
| ***A63B 22/06*** | (2006.01) |
| ***A63B 23/035*** | (2006.01) |

(52) U.S. Cl.
CPC ..... *A63B 22/001* (2013.01); *A63B 21/008* (2013.01); *A63B 21/00069* (2013.01); *A63B 21/4034* (2015.10); *A63B 21/4035* (2015.10); *A63B 22/0605* (2013.01); *A63B 23/03575* (2013.01); *A63B 2210/50* (2013.01)

(58) Field of Classification Search
CPC ..... A63B 22/0605; A63B 21/4034; A63B 21/4035; A63B 21/00069; A63B 21/008; A63B 23/03575; A63B 2210/50; A63B 22/0087; A63B 22/0046; A63B 22/0012
USPC ..... 482/58; D21/667
See application file for complete search history.

(56) References Cited

U.S. PATENT DOCUMENTS 3,578,800 A * 5/1971 DiNepi ..... A63B 22/0605 482/57
5,071,117 A * 12/1991 Mautner ..... A63B 21/00178 482/57
5,356,357 A * 10/1994 Wang ..... A63B 21/068 482/57
5,464,378 A * 11/1995 Yu ..... A63B 21/068 482/57
5,549,527 A * 8/1996 Yu ..... A63B 21/00196 482/57
5,556,361 A * 9/1996 Liao ..... A63B 21/068 482/72
5,569,132 A * 10/1996 Wu ..... A63B 21/068 482/72
5,582,562 A * 12/1996 Wang ..... A63B 21/068 482/57
5,626,542 A * 5/1997 Dalebout ..... A63B 21/068 482/72
5,643,150 A * 7/1997 Lee ..... A63B 21/068 482/76
5,672,142 A * 9/1997 Wu ..... A63B 22/0076 482/57

(Continued)

*Primary Examiner* — Andrew S Lo
(74) *Attorney, Agent, or Firm* — Rosenberg, Klein & Lee

(57) ABSTRACT

A foldable exercise bike includes a cross configuration formed by a main frame with a treading-driven rotation mechanism at bottom and a seat at top and a second frame with a pivoting portion pivoted to a handle. The main frame has a first-positioning device, and one end of the first-positioning device is selectively fixed on the second frame, so that the main frame can be fixed with the second frame. The second frame has a second-positioning device, and one end of the second-positioning device is selectively fixed on the handle, so that the second frame can be fixed with the handle. A resistance device is between the second frame and handle. The length of the resistance device can be changed when the handle is swung relative to the second frame, thereby generating a resistance force opposing to the swing motion of the handle.

6 Claims, 6 Drawing Sheets

(56) References Cited

U.S. PATENT DOCUMENTS 6,039,676 A * 3/2000 Clive ..... A63B 22/0605 482/57
7,097,598 B2 * 8/2006 Lee ..... A63B 22/0012 482/57
7,393,308 B1 * 7/2008 Huang ..... A63B 22/001 482/51
7,833,134 B2 * 11/2010 Gordon ..... A63B 22/0017 482/51
8,113,996 B1 * 2/2012 Allen ..... A63B 21/0088 482/57
9,056,220 B2 * 6/2015 Richards ..... A63B 21/0084
9,707,440 B2 * 7/2017 Zeng ..... A63B 22/0012
D807,443 S * 1/2018 Hsieh ..... D21/667
2002/0119867 A1 * 8/2002 Stearns ..... A63B 22/0007 482/52
2006/0172862 A1 * 8/2006 Badarneh ..... A63B 22/001 482/52
2006/0172867 A1 * 8/2006 Lee ..... A63B 22/0012 482/57
2006/0217238 A1 * 9/2006 Liao ..... A63B 23/03583 482/72
2006/0270527 A1 * 11/2006 Hanaya ..... A63B 24/00 482/57
2007/0161467 A1 * 7/2007 Lee ..... A63B 69/04 482/57
2008/0004163 A1 * 1/2008 Husted ..... A63B 22/0056 482/57
2010/0077564 A1 * 4/2010 Saier ..... A63B 22/0605 16/277
2011/0300997 A1 * 12/2011 Ilett ..... A63B 22/0007 482/80
2012/0115685 A1 * 5/2012 Bedell ..... A63B 22/001 482/52
2012/0322625 A1 * 12/2012 Park ..... A63B 22/0012 482/62
2014/0087923 A1 * 3/2014 Warren ..... A63B 22/0605 482/57
2015/0335936 A1 * 11/2015 Shakespeare ..... A63B 21/0084 482/58
2016/0082311 A1 * 3/2016 Massaro ..... A63B 22/0005 482/63
2016/0325146 A1 * 11/2016 Shin ..... G06Q 50/22
2016/0346595 A1 * 12/2016 Dalebout ..... A63B 22/0012
2017/0043207 A1 * 2/2017 Zeng ..... A63B 22/0012
2017/0259111 A1 * 9/2017 Hsieh ..... A63B 22/0605
2017/0291062 A1 * 10/2017 Chang ..... A63B 22/0087

* cited by examiner

FOLDABLE EXERCISE BIKE

BACKGROUND OF THE INVENTION

Field of the Invention

The present invention relates to exercise equipments, in particular to an exercise bike.

Description of the Prior Art

Nowadays, because of being busy, people do not have enough time to do exercise. Hence, because people can use indoor exercise equipments, such as exercise bikes, to go exercising at odd moments, these indoor equipments are popular. However, the sizes of the exercise equipments are generally large, thus the storage of the exercise equipments becomes an issue.

A conventional foldable exercise bike is developed to be stored conveniently. When the user finishes the exercise, the bike can be folded to reduce the size for storage. However, the conventional exercise bike allows the user to tread on its pedals repeatedly to achieve the training. Thus, the conventional exercise bike is adapted to exercise the lower limbs of the user and lacks of training modes for other parts of the user's body. As a result, the conventional is insufficient to achieve the training in every aspect.

SUMMARY OF THE INVENTION

One object of the present invention is to provide a foldable exercise bike, the handle of the foldable exercise bike can be swung relative to the frame, so that the user can pull or push the handle with his/her arms when the user treads on the pedal of the bike. Therefore, the user can train his/her upper limbs.

To achieve the above and other objects, a foldable exercise bike is provided and comprises:

a main frame, a bottom thereof having a rotation mechanism, and the rotation mechanism being driven by treading, and a top of the main frame having a seat;

a second frame pivoted to the main frame to form a cross configuration, wherein the main frame has a first positioning device, and one end of the first positioning device is selectively fixed on the second frame, so that the main frame and the second frame are fixed with each other, a top of the second frame has a pivoting portion;

a handle, a bottom thereof being pivoted to the pivoting portion of the second frame, so that the handle is swingable relative to the second frame, wherein the second frame has a second positioning device, and one end of the second positioning device is selectively fixed on the handle, so that the second frame and the handle are fixed with each other and a swing motion of the handle is limited;

a resistance device, one of two ends thereof being connected to the second frame, and the other end thereof being connected to the handle, wherein a length of the resistance device is changed when the handle is swung relative to the second frame, and the resistance device generates a resistance force opposing to the swing motion of the handle.

In one embodiment, the first positioning device comprises a connection bar pivoted to the main frame and a positioning bar fixed on the second frame. The connection bar is inserted into the positioning holder. The connection bar has a plurality of positioning holes. The positioning holder has a pin hole. One of the positioning holes of connection bar is adapted to correspond to the pin hole, and a pin is inserted into the pin hole and the positing hole for positioning.

In one embodiment, the second frame has a first connection holder for connecting to the resistance device, and the handle has a second connection holder for connecting to the resistance device. The first connection holder or the second connection holder has a plurality of connection ports for connecting to the resistance device, so that the resistance device is adapted to provide different initial resistance forces by combinations of different connection positions.

In one embodiment, the resistance device is a damper-type hydraulic cylinder.

In one embodiment, the top and a bottom of the second frame respectively have bent portions bent toward the main frame.

DETAILED DESCRIPTION OF THE PREFERRED EMBODIMENTS

Figure 1:
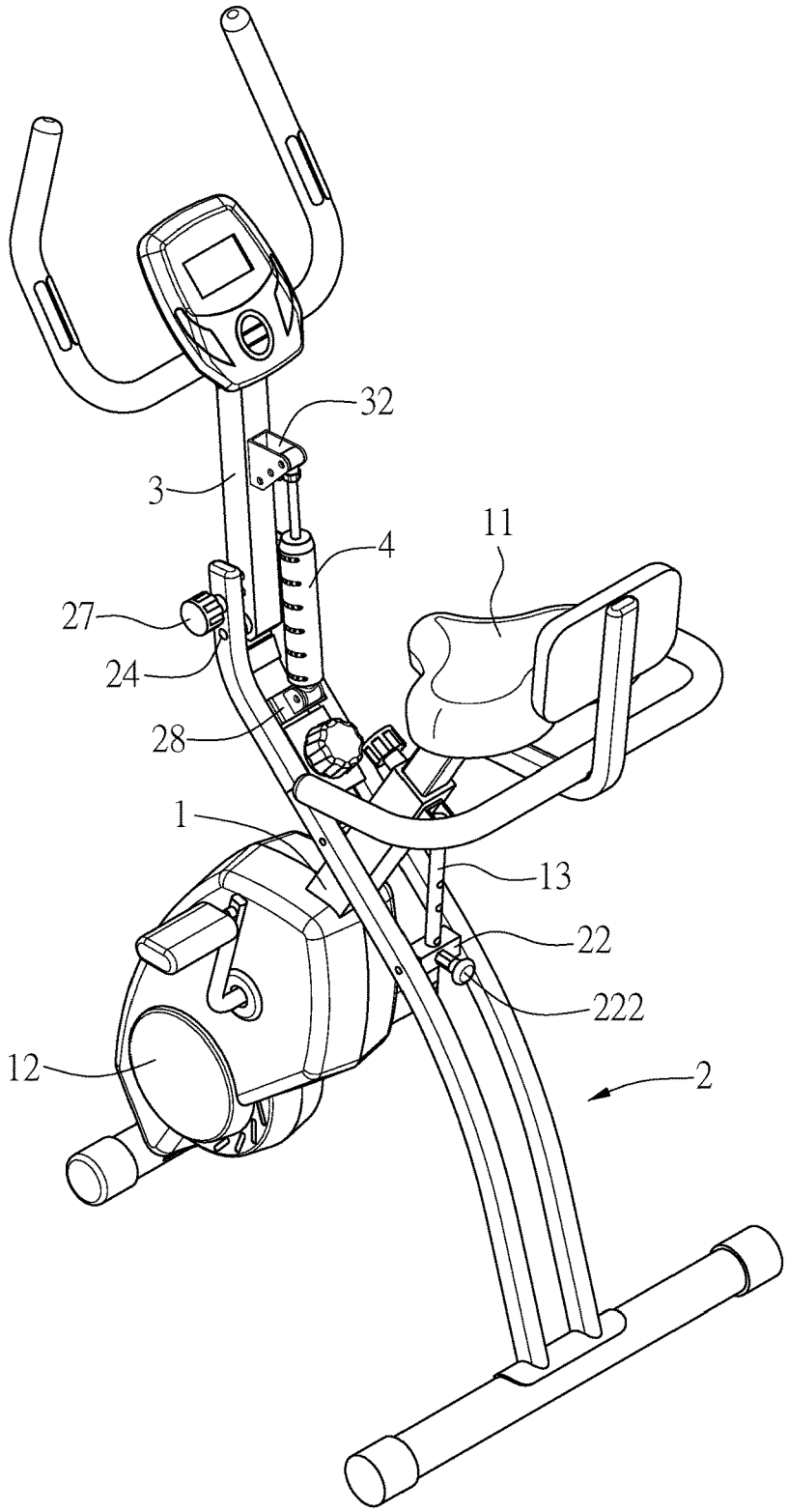
FIG. 1 illustrates a perspective view of an exemplary embodiment of the present invention.
Figure 2:
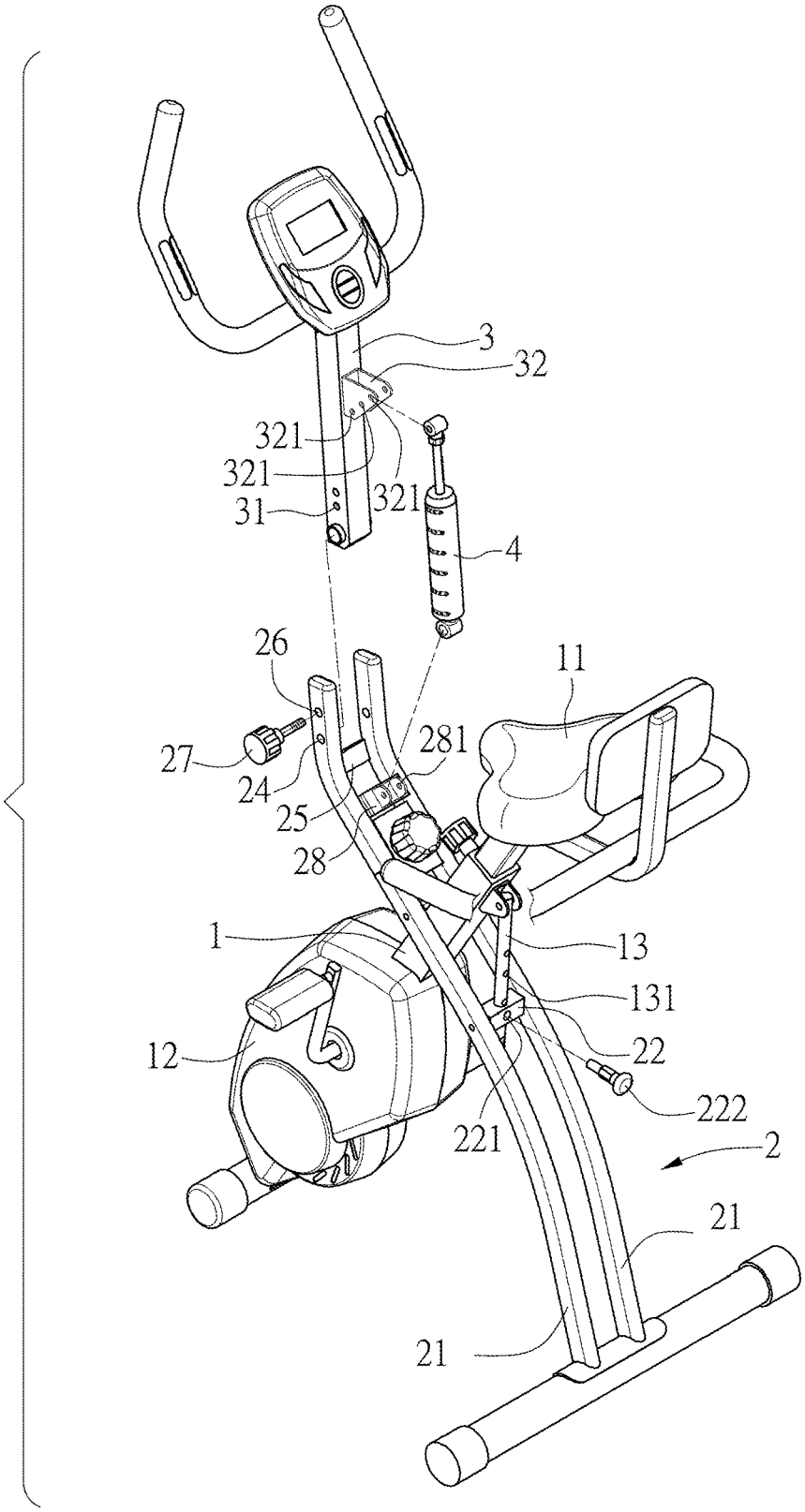
FIG. 2 illustrates an exploded view of the exemplary embodiment of the present invention.

Please refer to FIGS. 1 and 2, illustrating a foldable exercise bike of an exemplary embodiment of the present invention. The foldable exercise bike comprises a main frame (1) and a second frame (2) pivoted to the main frame (1) to form a cross configuration. The second frame (2) has two separated bars (21), and the main frame (1) is inserted between the two bars (21). A top of the main frame (1) has a seat (11). A bottom of the main frame (1) has a rotation mechanism (12), and the rotation mechanism (12) is driven by treading. The operation of the rotation mechanism (12) is conventional and detailed explanations about the operation are omitted. The rotation mechanism (12) may be used along with a device for providing resistance to increase the resistance force for rotating the rotation mechanism (12), so that the training effect for the users can be improved.

Further, the main frame (1) has a first positioning device, and one end of the first positioning device is selectively fixed on the second frame (2), so that when the foldable exercise bike is unfolded, the main frame (1) and the second frame (2) can be fixed with each other. In this embodiment, the first positioning device has a connection bar (13) and a positioning holder (22). One end of the connection bar (13) is pivoted to the main frame (1), and the positioning holder (22) is fixed on the second frame (2), and the connection bar (13) is inserted into the positioning holder (22). The connection bar (13) has a plurality of positioning holes (131), and the positioning holder (22) has a first pin hole (221). When the angle between the main frame (1) and the second frame (2) is changed, the connection bar (13) is inserted into the positioning holder (22) with different extents. One of the positioning holes (131) of the connection bar (13) is adapted to correspond to the first pin hole (221), and a first pin (222) is inserted into the positioning hole (131) and the first pin hole (221) at the same time, so that the main frame (1) and the second frame (2) can be fixed with each other.

Figure 3:
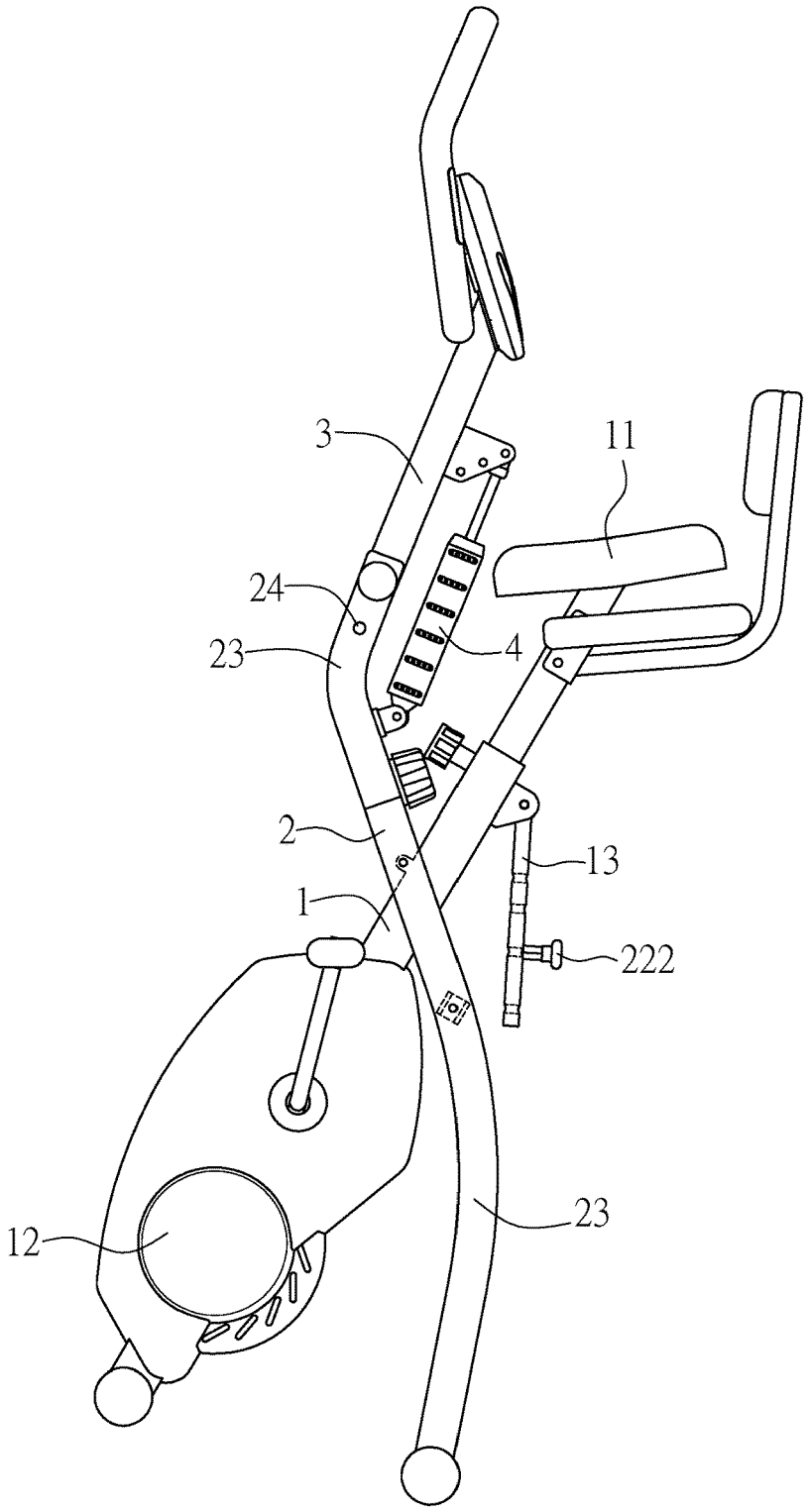
FIG. 3 illustrates a schematic view showing that the foldable exercise bike is in a folded condition.

Accordingly, when the first pin (222) is detached from the first pin hole (221) and the positioning hole (113), the main frame (1) can be swung relative to the second frame (2), so that the foldable exercise bike can be in a folded condition as shown in FIG. 3. Therefore, the size of the bike can be reduced for storage. In this embodiment, the top and a bottom of the second frame (2) respectively have bent portions (23) bent toward the main frame (1), so that the main frame (1) and the second frame (2) can be closely attached to each other when the main frame (1) is folded toward the second frame (2). Hence, in the folded condition, the size of the bike can be greatly reduced, as compared with its unfolded condition.

Conversely, a top of the second frame (2) has a pivoting portion (24), and a bottom of a handle (3) is pivoted to the pivoting portion (24) of the second frame (2), so that the handle (3) is swingable relative to the second frame (2). Further, the second frame (2) has a stopping plate (25) for limiting the swing motion of the handle (3). The second frame (2) has a second positioning device. One end of the second positioning device is selectively fixed on the handle (3), so that the second frame (2) and the handle (3) are fixed with each other, and the swing motion of the handle (3) is limited. In this embodiment, the second frame (2) and the handle (3) respectively have second pin holes (26, 31) at non-pivoting portions. When the second pin hole (26) of the second frame (2) and the second pin hole (31) of the handle (3) are aligned with each other, a second pin (27) is inserted into the second pin holes (26, 31), so that the handle (3) can be fixed with the second frame (2).

In addition, the resistance force for the swing motion of the handle (3) can be increased by using a resistance device (4). In this embodiment, the resistance device (4) is a damper-type hydraulic cylinder. One of two ends of the resistance device (4) is connected to the second frame (2), and the other end of the resistance device (4) is connected to the handle (3), and a length of the resistance device (4) is changed when the handle (3) is swung relative to the second frame (2), and the resistance device (4) generates a resistance force opposing to the swing motion of the handle (3). Furthermore, the second frame (2) has a first connection holder (28), and the handle (3) has a second connection holder (32). The first connection holder (28) or the second connection holder (32) has a plurality of connection ports for connecting to the resistance device (4). In this embodiment, the first connection holder (28) has one connection port (281), and the second connection holder (32) has three connection ports (321). One of two ends of the resistance device (4) is connected to the connection port (281) of the first connection holder (28), and the other end of the resistance device (4) is selectively connected to one of the connecting ports (321) of the second connection holder (32). The initial length of the resistance device (4) is different when different connection ports (281, 321) are selected. Therefore, the bike can provide different initial resistance forces for the users.

Figure 4:
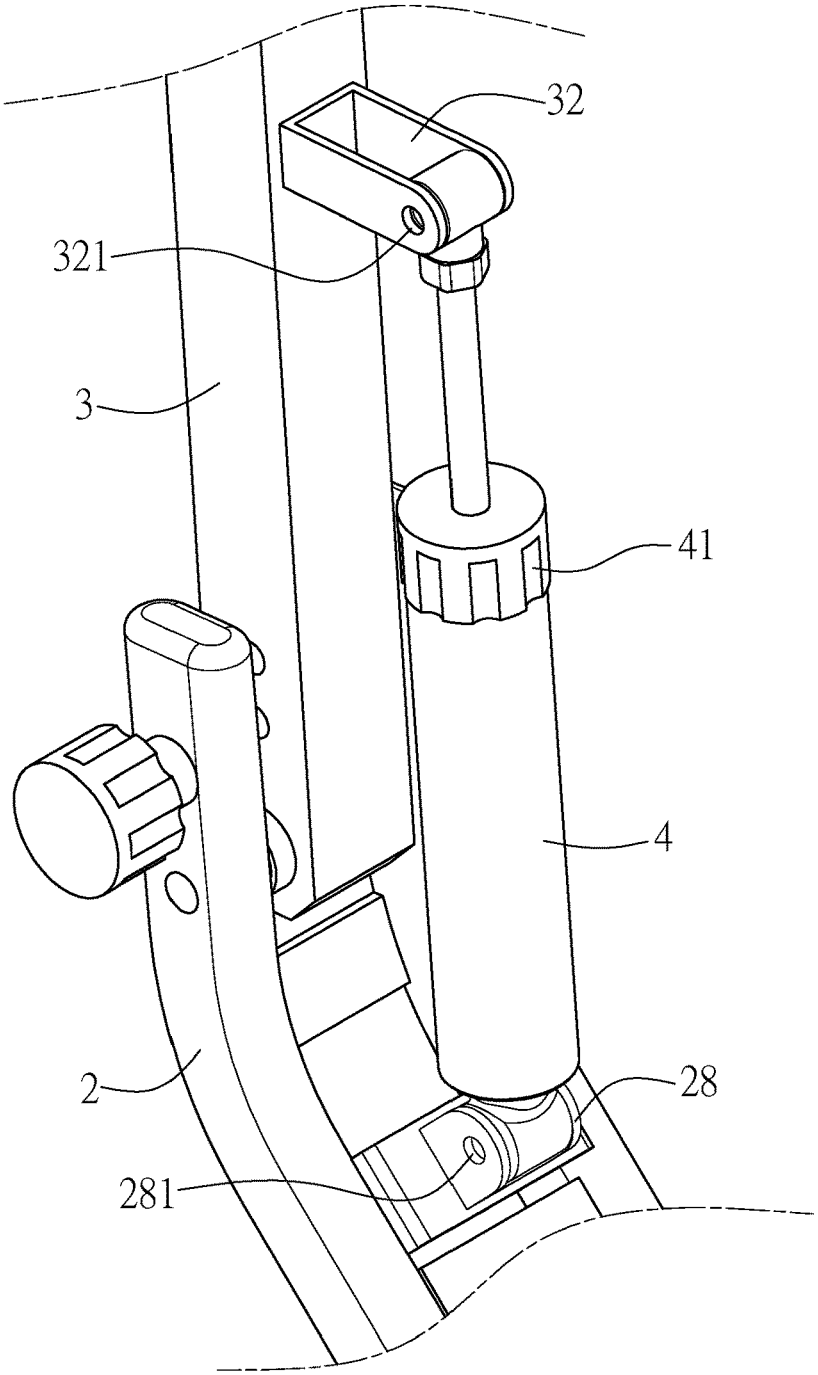
FIG. 4 illustrates a schematic view of another embodiment of a resistance device of the present invention.

Another embodiment of the resistance device (4) is provided, as shown in FIG. 4. In this embodiment, the first connection holder (28) and the second connection holder (32) respectively have one connection port (281, 321), and two ends of the resistance device (4) are respectively connected to the connection ports (281, 321). In this embodiment, the resistance device (4) is an adjustable damper. The resistance device (4) has an adjustable head (41), and the initial resistance force of the resistance device (4) relative to the handle (3) can be adjusted by rotating the adjustable head (41).

Figure 5:
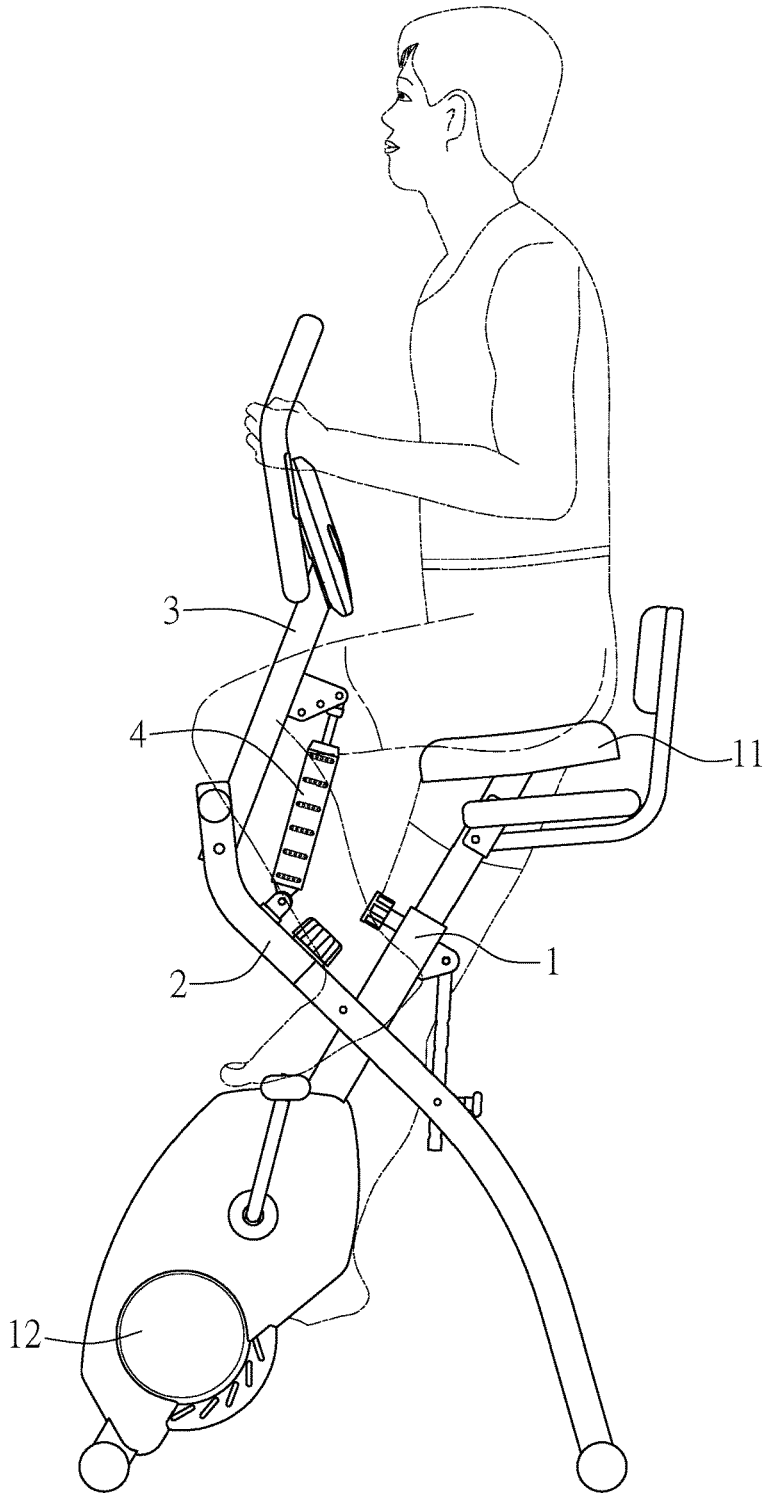
FIGS. 5 and 6 illustrate operational views of the exemplary embodiment of the present invention.
Figure 6:
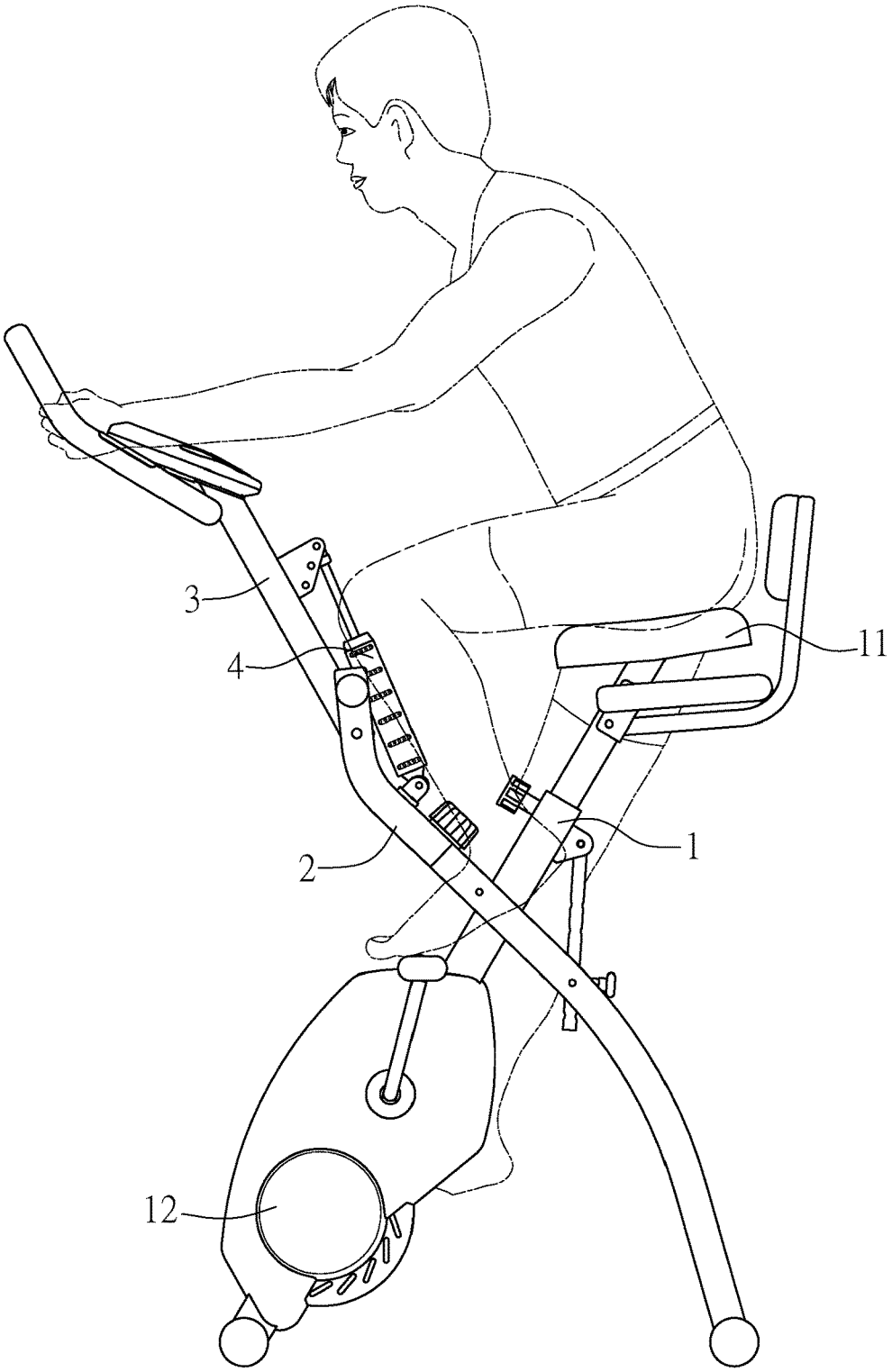

Accordingly, when the user sits on the seat (11) to do exercise with the present invention, the user not only can tread the rotation mechanism (12) repeatedly to train his/her limbs but also pull the handle (3) backwardly and push the handle (3) forwardly, as shown in FIGS. 5 and 6, so that the second frame (2) is pivotally moved relative to the handle (3). Hence, the user can train his/her arms and back muscle groups along with the lower limbs. Therefore, the training of the upper limbs can be achieved along with the training of the lower limbs, so that the user can train his/her body in every aspect, thereby allowing the present invention to have a wide application.

What is claimed is:

1. A foldable exercise bike, comprising:

a main frame, a bottom thereof having a rotation mechanism, and the rotation mechanism being driven by treading, and a top of the main frame having a seat;

a second frame pivoted to the main frame to form a cross configuration, wherein the main frame has a first positioning device, and one end of the first positioning device is selectively fixed on the second frame, so that the main frame and the second frame are fixed with each other, a top of the second frame has a pivoting portion;

a handle, a bottom thereof being pivoted to the pivoting portion of the second frame, so that the handle is swingable relative to the second frame, wherein the second frame has a second positioning device, and one end of the second positioning device is selectively fixed on the handle, so that the second frame and the handle are fixed with each other and a swing motion of the handle is limited;

a resistance device, one of two ends thereof being connected to the second frame, and the other end thereof being connected to the handle, wherein a length of the resistance device is changed when the handle is swung relative to the second frame, and the resistance device generates a resistance force opposing to the swing motion of the handle.

2. The foldable exercise bike according to claim 1, wherein the first positioning device comprises a connection bar pivoted to the main frame and a positioning holder fixed on the second frame, the connection bar is inserted into the positioning holder (22), the connection bar has a plurality of positioning holes, the positioning holder has a pin hole, one of the positioning holes of the connection bar is adapted to correspond to the pin hole, and a pin is inserted into the pin hole and the positioning hole for positioning.

3. The foldable exercise bike according to claim 1, wherein the second frame has a first connection holder for connecting to the resistance device, and the handle has a second connection holder for connecting to the resistance device, the first connection holder or the second connection holder has a plurality of connection ports for connecting to the resistance device, so that the resistance device is adapted to provide different initial resistance forces by combinations of different connection positions.

4. The foldable exercise bike according to claim 1, wherein the resistance device is a damper-type hydraulic cylinder.

5. The foldable exercise bike according to claim 1, wherein the resistance device is an adjustable damper.

6. The foldable exercise bike according to claim 1, wherein the top and a bottom of the second frame respectively have bent portions bent toward the main frame.

* * * * *